US005248353A

United States Patent [19]

Nishida et al.

[11] Patent Number: 5,248,353

[45] Date of Patent: Sep. 28, 1993

[54] METHOD OF PRODUCING STEEL WIRES EACH HAVING VERY SMALL DIAMETER, HIGH STRENGTH AND EXCELLENT DUCTILITY

[75] Inventors: Seiki Nishida; Ikuo Ochiai; Hiroshi Oba; Osami Serkiawa, all of Kimitsu, Japan

[73] Assignee: Nippon Steel Corporation, Tokyo, Japan

[21] Appl. No.: 835,432

[22] PCT Filed: Jun. 27, 1990

[86] PCT No.: PCT/JP90/00837

§ 371 Date: Feb. 25, 1992

§ 102(e) Date: Feb. 25, 1992

[87] PCT Pub. No.: WO92/00393

PCT Pub. Date: Jan. 9, 1992

[30] Foreign Application Priority Data

Dec. 28, 1988 [JP] Japan ..... 63-329428
Oct. 31, 1989 [JP] Japan ..... 1-281825

[51] Int. Cl.[5] ..... C22C 8/06
[52] U.S. Cl. ..... 148/598; 148/599
[58] Field of Search ..... 148/595, 598, 599

[56] References Cited

U.S. PATENT DOCUMENTS 4,889,567 12/1989 Fujiwara et al. ..... 148/598

FOREIGN PATENT DOCUMENTS 232558 8/1987 European Pat. Off. .
54-40459 12/1979 Japan .
60-204865 10/1985 Japan .
62-192532 8/1987 Japan .
62-238327 10/1987 Japan .
63-24046 2/1988 Japan .

*Primary Examiner*—Deborah Yee
*Attorney, Agent, or Firm*—Cushman, Darby & Cushman

[57] ABSTRACT

The present invention is concerned with a method of producing steel wires each having a very small diameter of 0.4 mm or less and a tensile strength of 360 kgf/mm$^2$ or more wherein a steel material having a composition comprising C: 0.90 to 1.10% by weight, Si: 0.4% or less by weight, Mn: 0.5% or less by weight, Cr: 0:10 to 0.30% by weight and a balance of iron an unavoidable impurities is subjected to diffusion treatment as desired, thereafter, the steel material is subjected to hot rolling, the hot-rolled steel wire is subjected to drawing, subsequently, the resultant steel rod having a smaller diameter is subjected to a final patenting treatment to give said rod a strength of 140 to 160 kgf/mm$^2$, and thereafter, it is subjected to drawing with a true strain of 3.50 or more using a die having a die approach angle of 8 to 12 degrees.

9 Claims, 2 Drawing Sheets

METHOD OF PRODUCING STEEL WIRES EACH HAVING VERY SMALL DIAMETER, HIGH STRENGTH AND EXCELLENT DUCTILITY

TECHNICAL FIELD

The present invention relates generally to steel wires each having a very small diameter, a high strength and excellent ductility preferably employable for producing a steel cord, a rope, a saw wire or the like. More particularly, the present invention relates to a method of producing steel wires each having a very small diameter of 0.4 mm or less, a high tensile strength of 360 kgf/mm$^2$ or more and excellent ductility by way of a step of wire drawing.

BACKGROUND ART

Usually, high carbon steel wires each having a very small diameter have been hitherto produced by way of the steps of allowing a steel material to be subjected to the rolling as desired, subsequently, controllably cooling the hot-rolled steel rod, allowing the cooled steel rod to be subjected to primary drawing to prepare a steel wire having a diameter of 5.0 to 5.5 mm, allowing the steel wire to be subjected to final patenting treatment, and thereafter, plating the steel wire with a brass, and finally, allowing it to be subjected to final drawing in a wet state. Many steel wires of the aforementioned type each having a very small diameter have been practically used in the form of a steel cord produced such that it is made of strands or bunches. As desired, a wire stranding or bunching operation is optionally performed to produce a steel cord having two steel wires stranded together, having seven steel wires stranded together or the like. To this end, it is necessary that each steel wire has excellent ductility sufficient to resist a severe wire stranding or bunching operation performed at high speed (in excess of 18000 rpm).

In addition, each steel wire is required to have high tensile strength, sufficient toughness and excellent resistibility against fatigue breakage. To satisfactorily meet the foregoing requirement, a variety of development works have been heretofore conducted to produce a steel material having a high quality.

For example, steel wires each having a very small diameter and sufficient toughness and high carbon steel wires employable as a steel cord, both of which are produced with low occurrence of wire breakage during a stranding operation by restrictively defining a content of manganese less than 0.3% to suppress the generation of an excessively cooled structure after completion of a lead patenting treatment, and moreover, restrictively defining the content of each of C, Si, Mn and other elements, are disclosed in an official gazette of Japanese Unexamined Publication Patent (Kokai) No. 60-204865. In addition, a steel rod usable for producing steel wires each having a very small diameter, sufficient toughness and excellent ductility, which are produced at a reduced drawing rate using steel rods each of which is subjected to a lead patenting treatment to elevate tensile strength with a content of silicon set to 1.00% or more, are disclosed in an official gazette of Japanese Unexamined Publication Patent (Kokai) No. 63-24046. Additionally, a steel rod having elements of Al, Ti, Nb and Zr added thereto by a quantity of 0.01% or more to improve ductility of the steel rod in the presence of a carbide and a nitride, wherein the maximum width of a segregation zone where carbon or manganese is segregated by a quantity as much as 1.3 times the average content of carbon or manganese within the range of less than a half of the radius of the steel rod as measured form the center of a cross-sectional plane of the steel rod determined to be 0.01 or less of a diameter of the steel rod are disclosed in an official gazette of Japanese Unexamined Publication Patent (Kokai) No. 62-238327.

The prior invention disclosed in the official gazette of Japanese Unexamined Publication Patent (Kokai) No. 60-204865 is concerned with a high carbon steel rod employable in producing steel wires each having a very small diameter of 0.5 mm or less and a tensile strength of 250 kgf/mm$^2$ or more by way of a step of wire drawing, and the prior invention disclosed in the official gazette of Japanese Unexamined Publication Patent (Kokai) No. 63-14046 is concerned with a high carbon steel rod employable in producing steel wires each having a very small diameter of 0.5 mm or less and a tensile strength of 300 kgf/mm$^2$ or more.

In recent years, however, earnest requests for increasing tensile strength of each steel wire for producing steel cords have been forthcoming from users in proportion to the latest accelerated reduction of the weight of each tire and increased performance of the same. To satisfy the foregoing requests, a variety of development works have been hitherto conducted to produce steel cords each having a tensile strength having an order of 340 kgf/mm$^2$. In addition, it is expected by users that steel codes each having a tensile strength of 360 kgf/mm$^2$ or more will be practically produced on an industrial basis.

DISCLOSURE OF THE INVENTION

The present invention has been made to obviate the drawbacks inherent to the prior art as mentioned above and its object resides in providing a method of producing steel wires each having a very small diameter and a tensile strength of 360 kgf/mm$^2$ or more without any deterioration of ductility.

Specifically, according to the present invention, there is provided a method of producing steel wires each having a very small diameter ranging from 0.4 to 0.03 mm, a tensile strength of 360 kgf/mm$^2$ or more, wherein the method is characterized in that a steel material having a composition of C: 0.090 to 1.10% by weight, Si: 0.4 or less by weight, Mn : 0.5% or less, Cr: 0.10 to 0.30% by weight and a balance of iron and unavoidable impurities is subjected to hot rolling, the hot-rolled steel rod is subjected to primary drawing to prepare a steel rod having a smaller diameter, this steel rod is subjected to a patenting treatment, causing the steel rod to have a strength ranging from 140 to 160 kgf/mm$^2$ thereby to provide a metallurgical structure including a proeutectoid ferrite and a proeutectoid cementite in terms of an area rate of 0.02% or less, and subsequently, the steel rod is subjected to final wire drawing in a wet state with a true strain of 3.50 or more.

With the steel wires each having a very small diameter produced by employing the method of the present invention, to assure that a strength of each steel wire is increased and the appearance of the proeutectoid ferrite is suppressed after completion of the patenting treatment, a carbon content is increased, and the appearance of the proeutectoid cementite and the deterioration of the configuration of a pearlite lamella occurred by the increased carbon are suppressed by an element chrominum added thereto. Consequently, increase of the tensile strength of each steel wire has been realized by refining the pearlite lamella. In addition, ductility of a cementite layer is improved to a level of ductility of a conventional steel material by refining the pearlite lamella in size in the above-described manner, whereby an increase of ductility of each steel wire has been realized by suppressing a quantity of the addition of elements of Cr, Si and Mn as far as possible thereby to maintain ductility of a ferrite phase at a level of the conventional steel material. Conclusively, the inventors have succeeded in elevating the strength and ductility of each steel wire in excess of those of the conventional steel material by properly designing a composition of each steel material so as to realize that a strength of each steel wire is increased and precipitation of the proeutectoid ferrite and the proeutectoid cementite is suppressed after completion of the patenting treatment merely by refining microstructure of steel in the above-described manner. Thus, in spite of the fact that the strength of each steel wire is elevated after completion of the patenting treatment, the method of the present invention assures that the ductility of the steel wires each having a very small diameter produced at an increased drawing rate is maintained at a level of the conventional steel material, thereby enabling steel wires each having a very small diameter to be produced with high strength and excellent ductility.

In addition, according to the present invention, an approach angle of a die to be used for performing a wire drawing operation is reduced to minimize the possibility of an interior flaw occurring during a primary wire drawing operation, and moreover, a die having a small die approach angle is used for performing a wire drawing operation in a wet state. Thus, it becomes possible to produce steel wires each having a very small diameter with high strength and excellent ductility by employing the method of the present invention.

Since a content of unavoidable impurities, e.g., aluminum is restrictively defined to be 0.003% or less, deterioration of ductility of each steel wire due to the presence of non-metallic inclusions can be avoided.

BEST MODE FOR CARRYING OUT THE INVENTION

Figure 1:
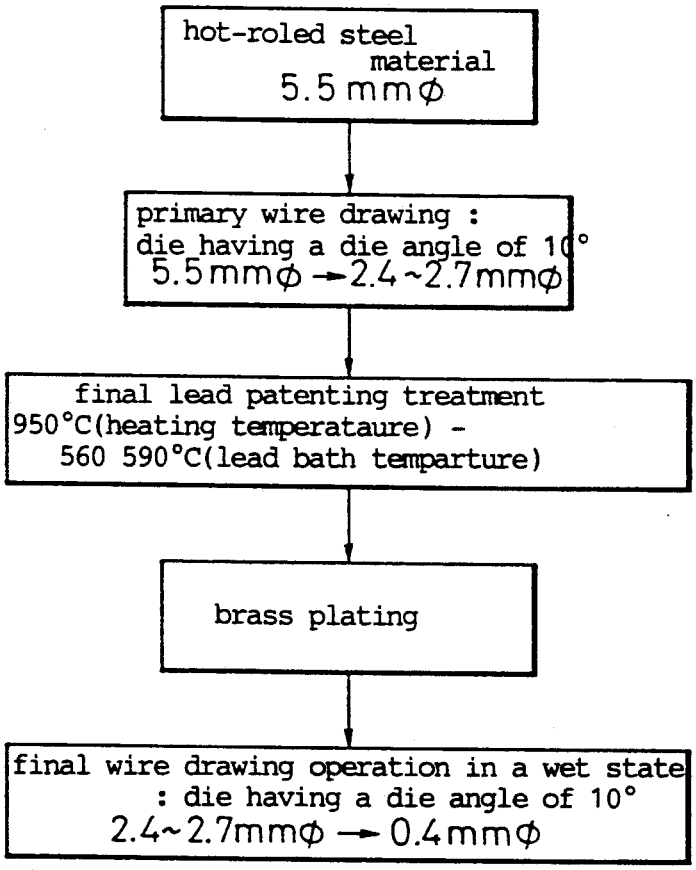
FIG. 1 is a diagram illustrating a series of steps of producing steel wires each having a very small diameter and conditions for producing the same by employing a method in accordance with an embodiment of the present invention.

Now, description will be made below with respect to the best mode for carrying out the present invention.

First, the reason the content of each component in a steel material used for practicing the method of the present invention is restrictively defined as mentioned above will be described below.

The inventors have discovered that a small quantity of proeutectoid ferrite precipitates along an old austenite grain boundary during the final patenting treatment when an eutectoid component comprising a carbon is contained in the steel material by a quantity near to 0.8% and that the proeutectoid ferrite leads to a factor reducing ductility of each steel wire after completing of the wire drawing operation. The carbon is not only an economical and effective reinforcing element but also an element effective for reducing the quantity of precipitation of the proeutectoid ferrite. Thus, it is necessary that a carbon content is defined to be 0.90% or more so as to improve ductility of the steel wires each having a very small diameter and a tensile strength of 360 kgf/mm$^2$. However, when the carbon content is excessively increased, the result is that ductility is degraded, and moreover, the drowability of each wire is undesirably reduced. For this reason, an upper limit of the carbon content is set to 1.10%.

A silicon is an element that is required for deoxidizing a steel material. Thus, when a silicon content is excessively reduced, a deoxidizing effect becomes unsatisfactory. In addition, the silicon is solved in the ferrite phase in the pearlite formed after completion of the heat treatment to elevate the strength of each steel wire after completion of the patenting treatment. On the contrary, however, the silicon degrades ductility of the ferrite, and moreover, degrades ductility of the steel wires each having a very small diameter after completion of a wire drawing operation. For this reason, the silicon content is restrictively defined to be 0.4% or less, and a lower limit of the silicon content is set to 0.1% which assures an effect derived from the addition of the silicon as a deoxidizing agent.

With respect to an element of manganese, it is desirable that a small quantity of manganese is added to a steel material so as to allow the steel material to maintain a certain quenching property. However, when a large quantity of manganese is added to the steel material, a part of the added manganese is undesirably segregated therefrom, and when the steel material is patented, causing an excessively cooled metallurgical structure containing a bainite and a martensite in the steel material with the result that a subsequent wire drawing operation is performed at reduced efficiency. For this reason, a manganese content is restrictively defined to be 0.5% or less, and a lower limit of the manganese content is set to 0.2% which assures an effect derived from the addition of the manganese to the steel material.

In the case of a hyper-eutectoid steel employed for practicing the method of the present invention, a cementite network is liable to appear in the metallurgical microstructure after completion of the patenting treatment, and moreover, a cementite having a heavy thickness is liable to appear therein. To assure that high tensile strength and excellent ductility are realized with the hyper-eutectoid steel, it is necessary that a pearlite be refined, and the cementite network and the heavy cementite as mentioned above are removed from the steel material. Chromium has the effect of suppressing the appearance of an abnormal portion such as the cementite, and moreover, refining the pearlite lamellar spacing. However, when a large quantity of chromium is added to the steel material, a dislocation density in the ferrite is undesirably increased after completion of the heat treatment, resulting in the ductility of the steel wires, each having a very small diameter after completion of the wire drawing operation, being significantly reduced. For this reason, a content of chromium added to the steel material is restrictively defined to be 0.10% or more which assures that an effect derived from the addition of the chromium to the steel material can be expected, and an upper limit of the chromium content is set to 0.30% or less, which assures that there is no possibility that the dislocation density in the ferrite will undesirably increase, resulting in the ductility of each steel wire being adversely affected.

Since the method of the present invention is intended to produce steel wires each having a very small diameter of 0.4 mm or less in the above-described manner, it is required that especially, the ductility of each steel wire is maintained. To meet the requirement, a content of unavoidable impurities such as S, P, Al, Cu, Ni or the like is restrictively defined as far as possible.

To assure that the ductility of each steel wire is maintained, it is desirable that a content of each of S and P is restrictively defined to be 0.020% or less. In addition, since an aluminum forms non-metallic inclusions such as $Al_2O_3$, $MgO\text{-}Al_2O_3$ or the like each containing $Al_2O_3$ as a main component, it is desirable that an aluminum content is restrictively defined to be 0.003% or less. Additionally, since a copper is a solid solution hardening element which functions to deteriorate the ductility of each steel wire, it is desirable that a copper content is defined to be less than 0.005%. Further, since a nickel is an element that functions to elongate transformation time, in the case of a high speed heat treatment line installed in a steel plant to produce steel wires each having a very small diameter by employing the method of the present invention, there is the possibility that a sufficiently long heat treatment time cannot be reserved unless line speed is reduced. For this reason, it is desirable that the nickel content is restrictively defined to be 0.05% or less.

Subsequently, the steel material for which a diffusion treatment has been conducted is subjected to hot rolling, as desired, to prepare a rod having a diameter of 5.0 to 5.5 mm. The hot-rolled rod is then subjected to primary wire drawing with the aid of a drawing die having a die angle ranging from 8 to 12 degrees to prepare a wire having a diameter of 2.4 to 2.7 mm.

As mentioned above, since the steel material employed for practicing the method of the present invention is a hyper-eutectoid steel, unfavorable portions are liable to appear in the metallurgical microstructure of the steel rod obtained after completion of the hot rolling operation. Each of the incorrect of portions becomes a source where fine cracking occurs during a step of primary wire drawing. However, it is practically difficult to minimize the occurrence of final crulery by improving the metallurgical structure of the steel rod because the steel material employed for practicing the method of the present invention is a hyper-eutectoid steel. The inventors have found that the foregoing problem can easily be solved by using a drawing die having a die approach angle ranging from 8 to 12 degrees while a drawing die having a die approach angle of 10 decrees is taken as a reference die. In general, when a high carbon steel rod is drawn, a drawing die having a die approach angle of 12 to 16 degrees is employed and a die approach angle of 14 degrees, which assures that the magnitude of force required for performing a wire drawing operation is reduced to an ultimate extent and is taken as a reference. In this case, however, since a tensile stress appears in the central part of each steel rod during a wire drawing operation, the steel rod assumes that fine cracking is liable to occur in the central part thereof. Under the aforementioned circumstances, to assure that a primary wire drawing operation is easily performed without occurrence of fine cracking, it is desirable, from the viewpoint of practical use, to employ a drawing die having a die angle ranging from 8 to 12 degrees and a die angle of 10 degrees, which assures that a sufficiently high intensity of compression stress functions on the central part of each steel wire and is taken as a reference.

Next, a description will explain the reason why the method of the present invention is practiced by way of the steps as mentioned above. First, a steel material (bloom or the like) having the aforementioned composition is subjected to a diffusion treatment. This diffusion treatment is conducted for the reason as noted below.

Specifically, it is necessary because of the hypereutectoid steel employed for practicing the method of the present invention such that an occurrence of segregation is suppressed much more than any conventional method no matter how a composition of the steel material employed for the method of the present invention is designed. For this reason, the steel material is subjected to diffusion treatment within the temperature range of 1250° C. to 1320° C. for 2 to 15 hours to reduce the occurrence of segregation in the steel material as far as possible. To this end, the maximum width of a segregation zone where an element of C or Mn is precipitated by a quantity in excess of 1.3 times an average quantity of the element in the steel material within the range of a half of the radius of the steel rod as measured from the center of a cross-sectional plane of the same is set to 0.01 or less of the diameter of the steel rod. In addition, with respect to segregation of chromium, since it becomes practically difficult to heat treat ideally because transformation characteristics of the steel material are vary remarkably unless an occurrence of segregation of the chromium is suppressed, it is desirable that the minimum width of the segregation zone, where the element of chromium is segregated by a quantity in excess of 1.3 times an average quantity of the element in the steel material within the range of a half of the radius of the steel rod as measured from the center of a cross-sectional plane of the steel rod, be set to 0.01 or less of a diameter of the steel rod.

In the case where it is acceptable that a cross-sectional area reduction rate of a final product and a working property of wire stranding or bunching of the same are slightly reduced or degraded, the step of diffusion treatment may be omitted. In this case, however, it is required that the steel material be subjected to hot rolling immediately after it is heated to an elevated temperature of 1250° C. to 1280° C. to prepare a steel rod having a diameter of 5.0 to 5.5 mm.

Subsequently, a patenting treatment is conducted for the steel rod prepared in that way. To assure that a final product of steel wires each having a very small diameter of 0.4 mm or less exhibits a tensile strength of 360 $kgf/mm^2$, it is necessary that the steel material exhibit a strength of 140 $kgf/mm^2$ after completion of the patenting treatment. When the strength of the steel material after completion of the patenting treatment exceeds 160 $kgf/mm^2$, an unfavorable portion such as a proeutectoid ferrite, a proeutectoid cementite or a bainite results in the ductility of each steel wire being degraded. For this reason, the strength of the steel wire after completion of the patenting treatment is determined to remain with the range of 140 to 160 $kgf/mm^2$.

To assure that the strength of the steel material after completion of the patenting treatment as mentioned above is obtained, it is required that the steel wire be first heated within the temperature range of 900° C. to 950° C. and the heated steel wire then be dipped in a molten lead bath kept hot within the temperature range of 550° C. to 620° C. (to conduct patenting treatment in the molten lead bath) or then immersed in a fluidized bed kept hot within the temperature range of 490° C. to 560° C. (to conduct patenting treatment in the fluidized bed).

After completion of the patenting treatment, the steel rod exhibits a metallurgical microstructure containing a proeutectoid ferrite and a proeutectoid cementite by a quantity of 0.02% or less in terms of an area rate.

The steel wire for which the patenting treatment has been conducted in the above-described manner is plated with brass and the brass plated steel wire is then conveyed to a step of final wire drawing to be performed in a wet state. To assure that each steel wire exhibits a tensile strength of 360 kgf/mm$^2$ after completion of the final wire drawing operation, it is recommended that the final wire drawing operation be accomplished with a true strain of 3.50 or more. In addition, to assure that each steel wire has excellent ductility after completion of the final drawing operation, it is desirable that a die having a die angle ranging from 8 to 12 degrees be employed while a die angle of 10 degrees is taken as a reference. This is because compression stress appearing in each steel wire is increased when a die approach having a smaller die angle is employed, resulting in the final wire drawing operation being performed more uniformly.

In such manner, when steel wires each having a very small diameter of 0.2 to 0.4 mm are produced by employing the method of the present invention, the result is that steel wires each having a very small diameter and a high tensile strength of 360 to 420 kgf/mm$^2$ while exhibiting excellent wire stranding or bunching performance and excellent ductility can be obtained. In addition, when the method of the present invention is employed, it has been found that steel wires each having a very small diameter of 0.1 mm, a tensile strength of 470 to 510 kgf/mm$^2$ and a cross-sectional area reduction rate of 20% or more can be obtained.

EMBODIMENTS

A steel cord was produced using a steel material of a particular component as shown in Table 1 by employing the method of the present invention.

It should be noted that steel materials A to J on the table represent steel materials each employed for practicing the method of the present invention and steel materials K to L represent comparative steel materials and that among the steel materials shown on the table, the steel materials A and B represent steel materials wherein segregation of elements of C, Mn and Cr were not reduced, respectively, and the steel materials C to J represent steel materials wherein segregation of the foregoing elements was reduced by employing the method of the present invention, respectively.

Production steps and production conditions are shown in Table 1.

TABLE 1

| | | Chemical composition of tested steel materials (wt. %) | | | | | | | | | |
|---|---|---|---|---|---|---|---|---|---|---|---|
| | mark | C | Si | Mn | Cr | P | S | Al | Cu | Ni | Maximum width of segregation zone/diameter of wire material |
| Steel materials of present invention | A | 0.95 | 0.20 | 0.35 | 0.20 | 0.010 | 0.008 | 0.003 | 0.01 | 0.01 | 0.014 |
| | B | 0.97 | 0.19 | 0.31 | 0.19 | 0.008 | 0.008 | 0.003 | 0.03 | 0.02 | 0.013 |
| | C | 0.92 | 0.20 | 0.30 | 0.20 | 0.010 | 0.008 | 0.003 | 0.01 | 0.01 | 0.009 |
| | D | 0.92 | 0.20 | 0.50 | 0.20 | 0.010 | 0.008 | 0.003 | 0.01 | 0.02 | 0.008 |
| | E | 0.95 | 0.20 | 0.26 | 0.20 | 0.012 | 0.006 | 0.002 | 0.02 | 0.02 | 0.009 |
| | F | 0.95 | 0.40 | 0.29 | 0.20 | 0.012 | 0.004 | 0.003 | 0.02 | 0.02 | 0.010 |
| | G | 0.97 | 0.20 | 0.25 | 0.10 | 0.008 | 0.006 | 0.003 | 0.01 | 0.03 | 0.009 |
| | H | 0.97 | 0.20 | 0.27 | 0.20 | 0.008 | 0.006 | 0.003 | 0.01 | 0.02 | 0.009 |
| | I | 1.00 | 0.20 | 0.31 | 0.20 | 0.008 | 0.007 | 0.002 | 0.02 | 0.01 | 0.010 |
| | J | 1.08 | 0.20 | 0.29 | 0.10 | 0.010 | 0.007 | 0.003 | 0.02 | 0.01 | 0.009 |
| Comparative steel materials | K | 0.82 | 0.20 | 0.50 | 0.00 | 0.002 | 0.003 | 0.003 | 0.02 | 0.02 | 0.015 |
| | L | 0.82 | 0.20 | 0.29 | 0.10 | 0.003 | 0.004 | 0.003 | 0.03 | 0.01 | 0.014 |

First, an effect of suppressing an occurrence of micro cracking on a die having a small die angle is shown on Table 2. As is apparent from the table, an occurrence of fine cracking could be reduced to an ultimate extent by using a die having an approach angle of 10 degrees.

TABLE 2

| | Comparison on the number of microcracks recognized | |
|---|---|---|
| | Die having a die angle of 14 degrees | Die having a die angle of 10 degrees |
| The number of cracks recognized* | 5 | 0 |

Note: A mark (x) represents that a steel wire having a diameter of 5.5 mm was reduced to a diameter of 2.50 mm by way of a step of wire drawing.

Figure 2:
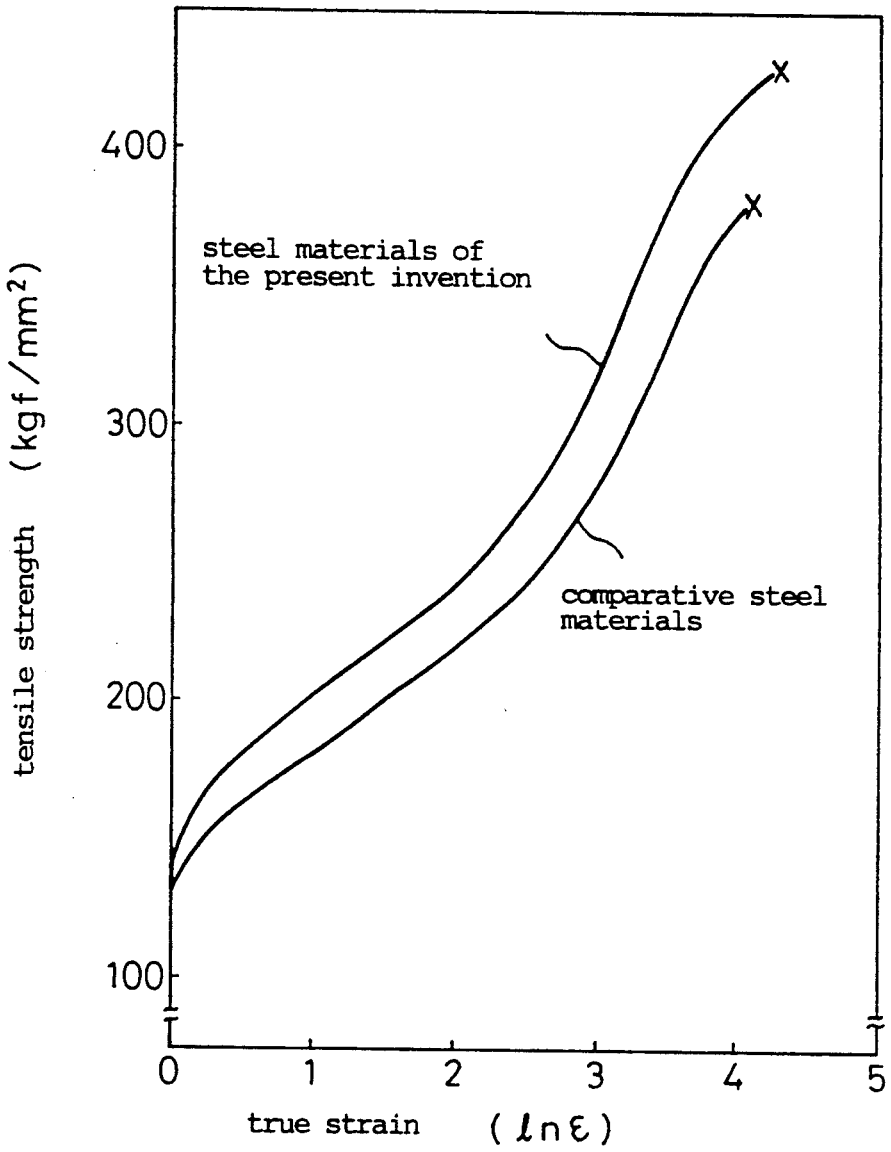
FIG. 2 is a diagram illustrating the relationship between tensile strength of each steel material and a rate of reducing a cross-sectional area of the steel wire until it is worked to an ultimate extent, with respect to steel materials of the present invention and comparative steel materials.

Material properties of steel wires produced by way of production steps shown in FIG. 1 are shown on Table 3 wherein they were measured after completion of final lead patenting (hereinafter referred to simply as final LP). When the method of the present invention was employed, a strength of each steel wire having a very small diameter after completion of the final LP was controlled to remain within the range of 140 to 160 kgf/mm$^2$. In addition, material properties of steel cords produced by way of a step of final drawing in a wet state are shown in Table 4. In this table, a working performance of bunching represents a value derived from dividing a breakage stress by a tensile strength wherein the foregoing breakage stress was measured when steel wires were bunched together with a pitch of 5 mm at a rotational speed of 18000 rpm. It is apparent from the table that a strength of 360 kgf/mm$^2$ could be obtained with comparative steel materials (K, L) but each of the comparative steel materials (K, L) exhibits remarkable deterioration of a working performance of bunching, whereas a high strength of 400 kgf/mm$^2$ could be obtained with steel materials (A to J) of the present invention and each of the steel materials (A to J) of the present invention exhibits excellent standing performance. In addition, a relationship between tensile strength and rate of reduction of a cross-sectional area of each steel wire until it is worked to an ultimate extent is shown in FIG. 2 with respect to the steel materials of the present invention and the comparative steel materials. As shown in the drawing, the ultimate working extent of the steel materials of the present invention is elevated compared with the comparative steel materials.

TABLE 3

| | Mark | LP condition (°C.) | Tensile strength (kgf/mm²) | Rate of reduction of cross-sectional area (%) | Appearance of abnormal phase* area reduction rate (%) |
|---|---|---|---|---|---|
| | | Material properties after completion of final LP | | | |
| Steel materials in present invention | A | 950 to 575 | 148.3 | 26.3 | 0.018 |
| | B | 950 to 575 | 150.4 | 25.0 | 0.017 |
| | C | 950 to 590 | 144.4 | 42.6 | 0.013 |
| | D | 950 to 560 | 148.7 | 45.5 | 0.014 |
| | E | 950 to 575 | 147.5 | 39.0 | 0.017 |
| | F | 950 to 590 | 144.2 | 42.9 | 0.012 |
| | G | 950 to 560 | 150.6 | 38.5 | 0.015 |
| | H | 950 to 575 | 150.3 | 37.7 | 0.013 |
| | I | 950 to 575 | 154.3 | 34.3 | 0.017 |
| | J | 950 to 560 | 158.8 | 32.9 | 0.019 |
| Comparative steel material | K | 950 to 550 | 132.6 | 40.2 | 0.063 |
| | L | 950 to 575 | 136.8 | 40.7 | 0.047 |

Note: A mark (x) represents a proeutectoid cementite and a proeutectoid ferrite.

TABLE 4

| | Sample | Quantity of wire drawing (lnε) | Tensile strength (kgf/mm²) | Value after 100d twists (times) | Performance of of wire bunching |
|---|---|---|---|---|---|
| | | Material properties after completion of wire drawing operation | | | |
| Steel materials of present invention | A | 3.81 | 412.0 | 22.0 | 0.20 |
| | B | 3.79 | 419.0 | 23.0 | 0.19 |
| | C | 3.79 | 403.5 | 19.3 | 0.26 |
| | D | 3.69 | 402.2 | 19.0 | 0.27 |
| | E | 3.70 | 404.5 | 20.7 | 0.32 |
| | F | 3.74 | 400.9 | 21.0 | 0.31 |
| | G | 3.68 | 402.1 | 22.4 | 0.31 |
| | H | 3.68 | 404.8 | 22.6 | 0.32 |
| | I | 3.62 | 403.5 | 20.0 | 0.27 |
| | J | 3.60 | 402.8 | 19.3 | 0.26 |
| Comparative steel material | K | 3.79 | 360.5 | 11.7 | 0.08 |
| | L | 3.69 | 363.8 | 19.0 | 0.11 |

INDUSTRIAL APPLICABILITY

Steel wires each having a very small diameter produced by employing the method of the present invention have a diameter of 0.4 mm, respectively, but exhibit high tensile strength ranging from 360 to 420 kgf/mm² as well as excellent wire bunching performance. Thus, the steel wires are most suitable employed in the production of steel cords, ropes or saw wires, and moreover, they have a wide industrial utilization range.

We claim:

1. A method of producing a steel wire having a very small diameter, a high tensile strength of 360 kgf/mm² or more and excellent ductility, comprising the steps of:

hot rolling a steel material having a composition comprising

C: 0.90 to 1.10% by weight,

Si: 0.4% or less by weight,

Mn: 0.5% or less by weight,

Cr: 0.10 to 0.30% by weight and a balance of iron and unavoidable impurities to thereby form a steel rod;

drawing said steel rod to reduce a diameter of said steel rod;

subjecting said reduced diameter steel rod to a patenting treatment whereby said reduced diameter steel rod has a strength of about 140 to 160 kgf/mm²; and drawing said reduced diameter steel rod in a wetted state with a true strain of 3.50 or more to thereby produce said small diameter steel wire having a high tensile strength of 360 kgf/mm² or more and excellent ductility.

2. The method as claimed in claim 1, wherein said unavoidable impurities comprise S: 0.020% or less, P: 0.020% or less, Al: 0.003% or less and one of Cu: less than 0.050% and Ni: 0.05% or less.

3. The method as claimed in claim 1, further comprising the step of diffusion treating said steel material within a temperature range of about 1250° C. to 1320° C. for about 2 to 15 hours before said hot rolling step.

4. The method as claimed in claim 1, wherein said patenting treatment is conducted by dipping said reduced diameter steel rod in a molten lead bath kept within a temperature range of about 550° C. to 620° C., after said reduced diameter steel rod is heated within a temperature range of about 900° C. to 950° C.

5. The method as claimed in claim 1, wherein said patenting treatment is conducted by immersing said reduced diameter steel rod in a fluidized bed kept within a temperature range of about 490° C. to 560° C., after said reduced diameter steel rod is heated within a temperature range of about 900° C. to 950° C.

6. The method as claimed in claim 1, wherein a die approach angle in a die used for performing at least one of said drawing steps is set to about 8 to 12 degrees.

7. The method as claimed in claim 1, wherein said steel wire has a diameter in the range of about 0.4 to 0.03 mm.

8. The method as claimed in claim 1, wherein a microstructure of said reduced diameter steel rod after completion of said patenting treatment step using a molten lead bath contains proeutectoid ferrite and proeutectoid cementite at an area rate of 0.02% or less.

9. The method as claimed in claim 1, further comprising the step of subjecting said steel material to a diffusion treatment before hot rolling said steel material, wherein a maximum width of a segregation zone within a range of a half of a radius of said steel material measured from a center of a cross-sectional plane of said steel material and where elements of C, Mn or Cr are segregated by a concentration in excess of 1.3 times an average concentration of each of said elements in said steel material is set to 0.01 times or less of a diameter of said steel material by said diffusion treatment step.

* * * * *